United States Patent [19]

Olson

[11] Patent Number: 4,768,311

[45] Date of Patent: Sep. 6, 1988

[54] FLOOR PREPARATION MACHINE AND METHOD

[75] Inventor: Donald L. Olson, Minneapolis, Minn.

[73] Assignee: Tennant Company, Minneapolis, Minn.

[21] Appl. No.: 28,660

[22] Filed: Mar. 20, 1987

[51] Int. Cl.[4] ..... B24B 7/18

[52] U.S. Cl. ..... 51/174; 51/328

[58] Field of Search ..... 51/174, 176, 281 R, 51/317, 328, 170 R, 170 EB; 125/11 CD

[56] References Cited

U.S. PATENT DOCUMENTS

| | | | |
|---|---|---|---|
| 891,251 | 6/1908 | Harbers | 51/174 |
| 1,640,933 | 8/1927 | Gries | 51/174 |
| 1,957,823 | 5/1934 | Feenan | 51/170 EB |
| 2,200,592 | 5/1940 | Coddington | 51/78 |
| 2,279,783 | 4/1942 | Fowler | 51/170 EB |
| 2,280,762 | 4/1942 | Phipps | 51/170 EB |
| 2,765,598 | 10/1956 | Judd | 51/281 |
| 3,522,679 | 8/1970 | Sundberg . | |
| 3,744,188 | 7/1973 | Sharpless | 51/174 |
| 3,882,648 | 5/1975 | Buchinski | 51/328 |

FOREIGN PATENT DOCUMENTS

| | | | |
|---|---|---|---|
| 5240 | of 1909 | United Kingdom | 51/174 |

*Primary Examiner*—Roscoe V. Parker

*Attorney, Agent, or Firm*—Kinzer, Plyer, Dorn, McEachran & Jambor

[57] ABSTRACT

A machine and method for removing coatings and/or membranes from the surface of a floor or the like, which may be uneven, and also conditioning a floor so that it more readily acccepts a new coating. The machine takes the form of a driver member or element which may be abrasive or which may apply or work free abrasive particles against a floor with a controlled application rate that may be related to floor conditions and travel speed of the machine over the surface.

58 Claims, 4 Drawing Sheets

Fig. 1.
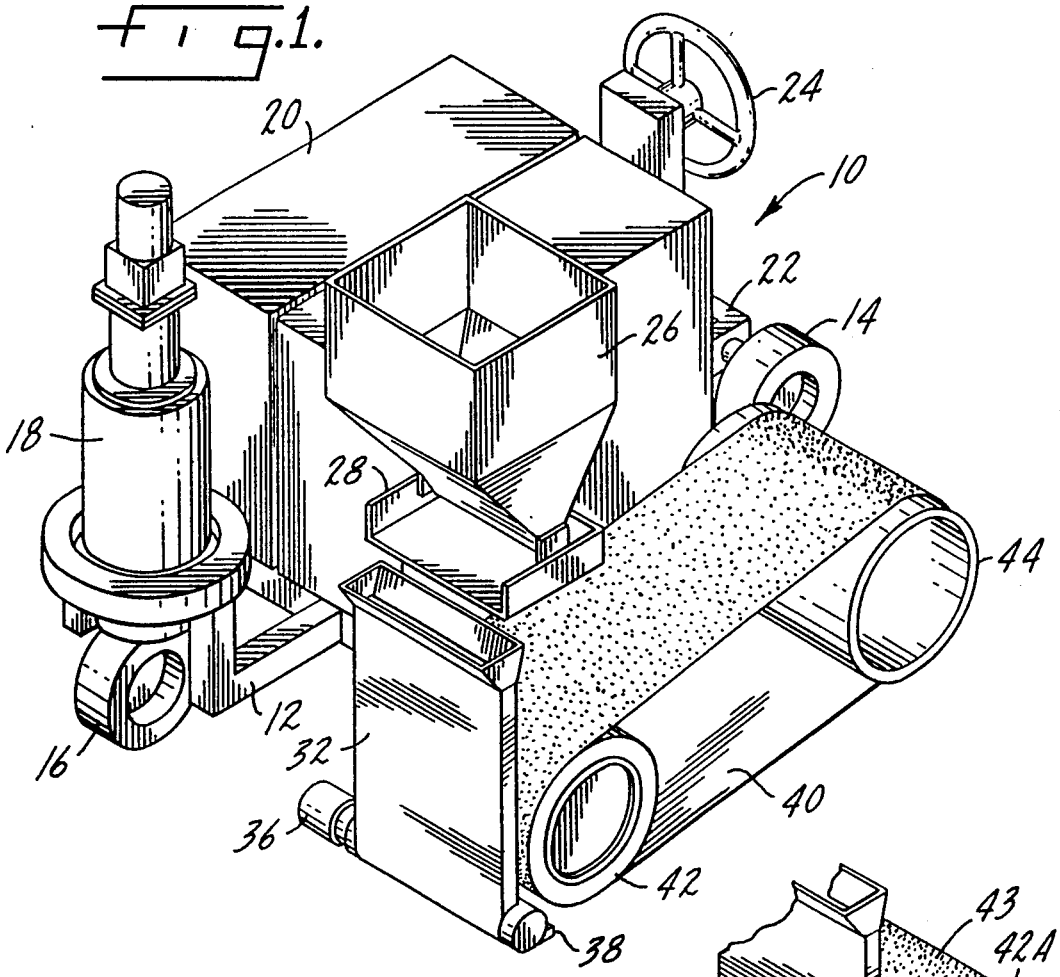
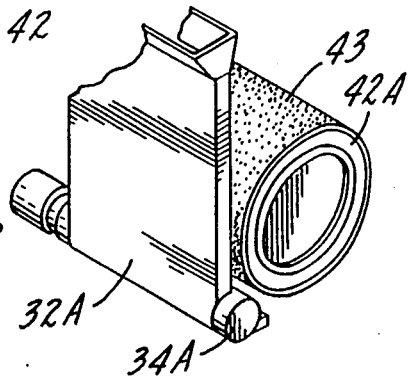
Fig. 1A.
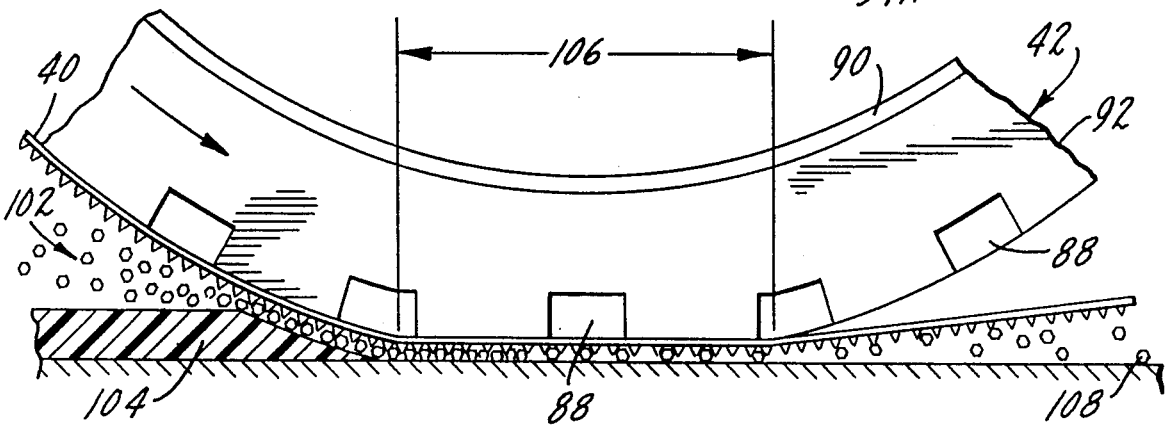
Fig. 3.

Fig. 5.
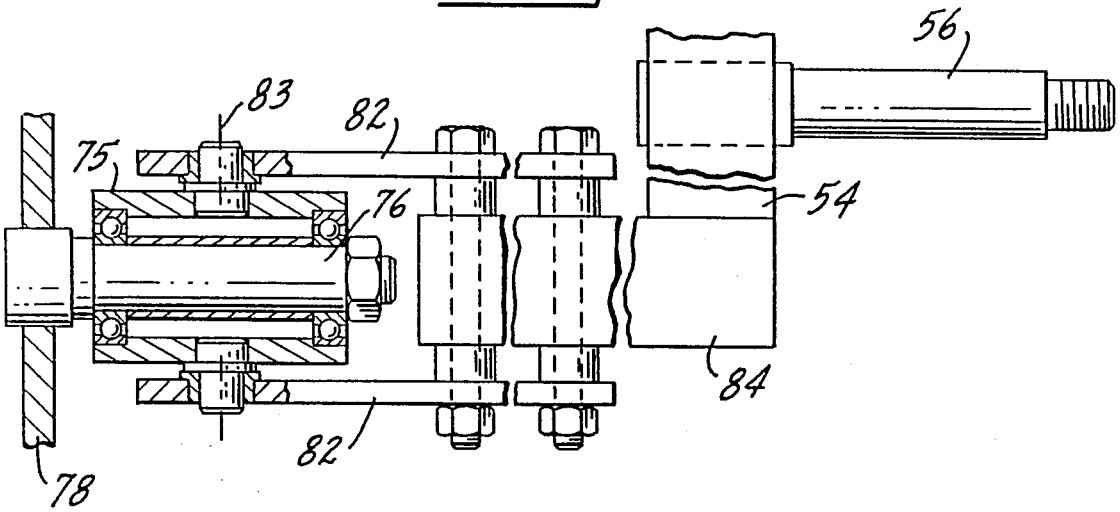
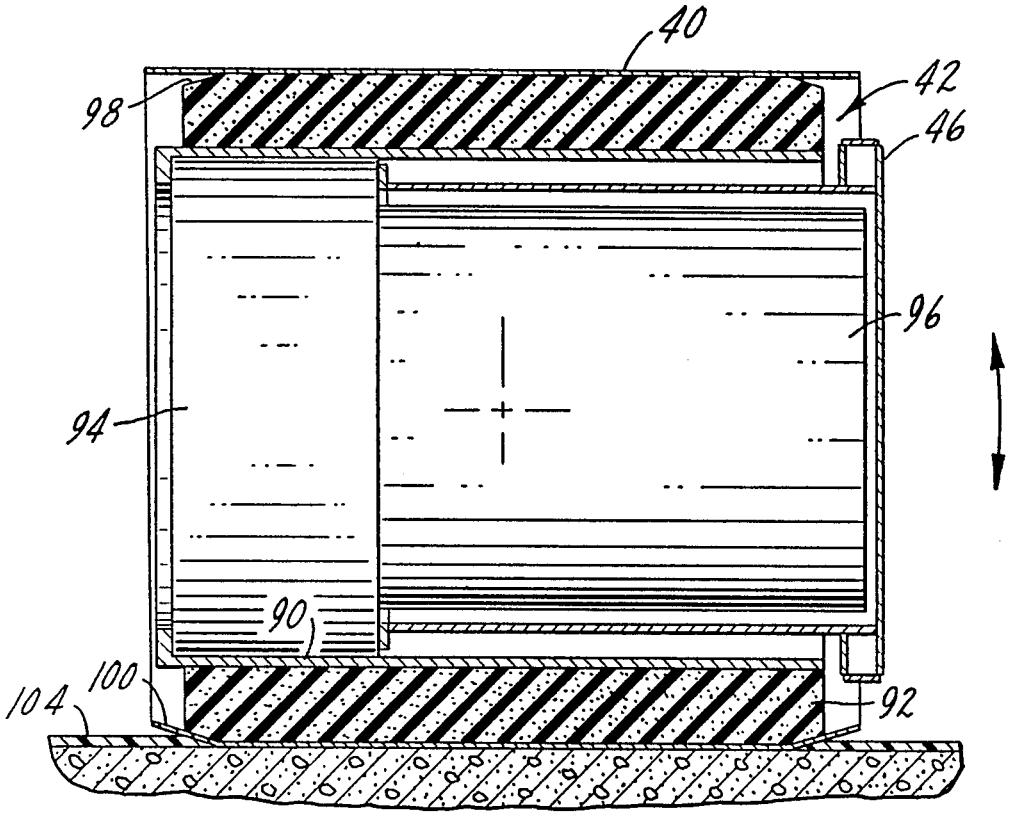
Fig. 6.

FLOOR PREPARATION MACHINE AND METHOD

SUMMARY OF THE INVENTION

This invention is concerned with a machine and method for working a floor so as to uniformly remove coatings and/or a membrane from the surface of the floor although the surface may be uneven, while at the same time preparing the floor for the reception of a new coating.

A primary object of the invention is a machine and method which avoids the use of chemicals, such as solvents, to remove coatings or membranes, and therefore does not release any toxic materials into the atmosphere nor generate any toxic or hazardous waste material, and which does not incur the cost of disposing of toxic wastes.

Another object is a machine and method which uses free abrasive particles in combination with a driver member which may take the form of an abrasive belt or cylinder so that the free particles do most if not all of the work of removing the coating or membrane and the belt or cylinder itself is a driver or carrier rather than the primary grinding element.

Another object is a method and machine of the above type with a resilient or flexible roller and abrasive medium combination which provides effective conformability to uneven floor surfaces, thereby quite uniformly removing coatings and/or membranes from such floors.

Another object is a pivoted mounting for the resilient roller in a machine of the above type to increase the ability of the machine to conform to floor contours.

Another object is a machine and method of the above type which may be used on concrete floors that are new and that have a curing membrane on them or may be used on old floors that have a worn coating and also may be used on bare concrete floors to prepare any of them to receive a new coating.

Another object is a machine and method of the above type which is more economical than prior methods of removing floor coatings.

Another object is a machine and method of the above type which is much faster than prior chemical procedures and will not leave any slippery surfaces such as chemical procedures sometimes do.

Another object is a machine and method of the above type which leaves a uniform surface by providing an even removal process.

Another object is a belt and roller arrangement of the above type with a cleaning mechanism which prevents the belt from loading up or clogging with removal residue.

Another object is a machine and method of the above type which is adequately aggressive without being overly aggressive.

Another object is a method of feeding free abrasive to a machine of the above type to insure that the abrasive is in the cutting zone without overfeeding or underfeeding, either of which will reduce the cutting action of the abrasive.

Another object is a machine and method of the above type which removes all of the coating in one pass.

Another object is a machine and method of the above type which insures the right texture of the concrete, i.e. it will bond a new coating securely without absorbing an excessive amount of coating material.

Another object is a machine and method which will remove urethane, epoxy, paints, compacted soilage, etc. from a floor surface.

Another object is to eliminate any need to acid etch a floor prior to coating it.

Another object is a machine and method that insures proper blending of adjacent cuts or strips.

Another object is a machine and method of the above type where the necessary power can be provided on a mobile machine.

Another object is a machine and method of the above type using a free abrasive for removing surface coatings, or for cleaning, renovating or scarifying surfaces.

Another object is a machine and method of the above type which does not generate so much heat that it softens or melts a floor coating but at the same time effectively removes various types of coatings.

Another object is a machine and method which does not release any dust into the atmosphere.

Another object is a machine and method which can grind off an old finish or surface from vinyl floor tiles or wood floors, or remove rubber marks from airport runways.

Other objects will appear from time to time in the ensuing specification and drawings.

BRIEF DESCRIPTION OF THE DRAWINGS

FIG. 1 is a perspective of the machine.

FIG. 1A is a portion of a perspective of a variant form.

FIG. 3 is an enlargement of a part of FIG. 2;

FIG. 5 is a section taken along line 5—5 of FIG. 4 on an enlarged scale; and FIG. 6 is a section along line 6—6 of FIG. 2 on an enlarged scale.

BRIEF DESCRIPTION OF THE PREFERRED EMBODIMENT

Figure 2:
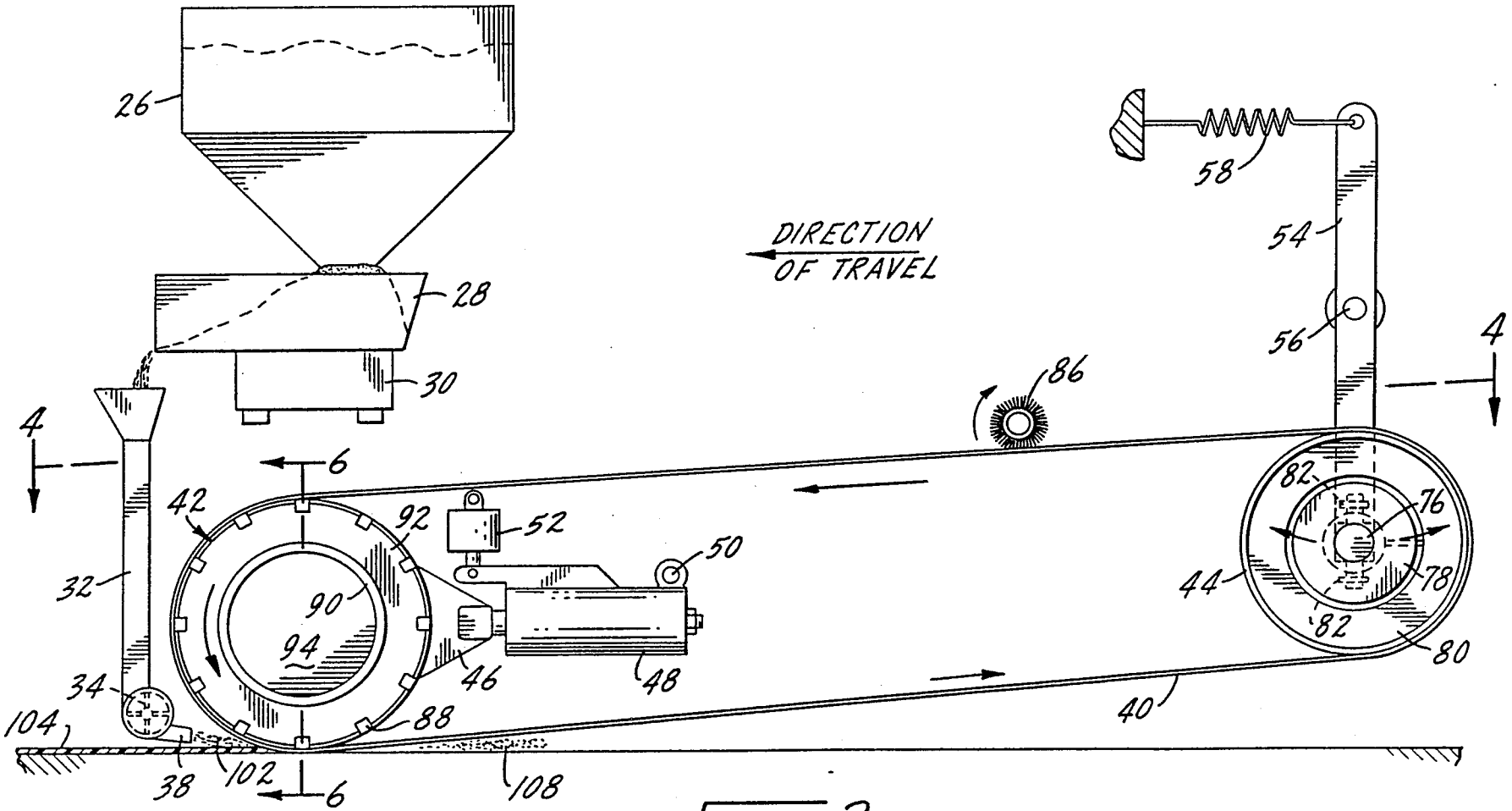
FIG. 2 is a side view on an enlarged scale of a part of FIG. 1, with parts removed and broken away for clarity.

In FIG. 1 a machine is shown at 10 which may have a suitable frame 12 with suitable wheels 14 and 16 or the like. It may be assumed that there are two rear wheels 14 and one front wheel 16 although it may be otherwise. In the present case, the front wheel steers and has a propelling motor 18 which may be powered by batteries 20 although the unit may be engine driven. A driver's platform 22 and steering wheel 24 of any suitable type may also be used.

Mounted on the machine in any suitable manner is a hopper 26 which contains a suitable granular abrasive, as explained hereinafter. The bottom of the hopper may open over a vibratory tray 28 of any suitable type so that the free granular abrasive will fall off of its front edge as shown in FIG. 2. The vibrator, shown at 30 in FIG. 2, may be of any suitable type and may be adjustable so as to control the feed rate.

The granular abrasive falls into an abrasive chute 32 which has a rotary slinger 34 at its lower end which may be driven by a suitable motor 36 or the like. The abrasive is propelled out through a nozzle 38 onto a surface being worked upon.

A suitable flexible abrasive driver belt 40 disposed about a forward work wheel 42 and a rear idler drum 44 is forced against the surface under the work wheel 42.

The work wheel is shown as supported by a suitable support arm 46 in FIGS. 2 and 4 with the mounting and drive projecting in one end of the work wheel as explained hereinafter. The support arm 46 is mounted on a longitudinal roll pivot 48 which is laterally pivoted, as at 50, to the frame of the machine in any suitable manner. The roll pivot 48 is approximately lined up with the center of the work wheel so that the work wheel may pivot about its axis to conform to any irregularity in the surface being worked upon. A hydraulic cylinder 52 in FIG. 2 may be used to apply a controllable down force on the work wheel 42 by pivoting it up or down on the pivot 50. The oil supply to cylinder 52 is maintained at a constant pressure by, for example, an adjustable relief valve which can be set at any desired pressure, so the down force on work wheel 42 can be set as desired and will then remain constant, even when the work wheel moves up or down in the process of following floor contours.

Whereas the mechanism for maintaining a constant down force on the work wheel has been shown and described as being hydraulic, it should be understood that it could be otherwise, e.g. electrical or pneumatic. In an electrical set up, a load cell could be interposed between the work wheel and an electrical actuator which would automatically either extend or retract in response to increased or decreased load on the work wheel caused by variations in the surface contour. This would be in the nature of a closed loop force sensing servo system. A pneumatic system could use an air compressor and storage tank to supply an air cylinder through a pressure regulator which would be adjustable and which could be set for any pressure desired.

The idler drum 44 at the other end of the flexible driver is spaced slightly above the surface or floor being worked upon and may be mounted on a suitable arm 54 which may be pivoted at 56 to be biased by a spring, an air cylinder or any suitable biasing means 58, to move the idler drum 44 rearwardly thereby tensioning the belt.

Figure 4:
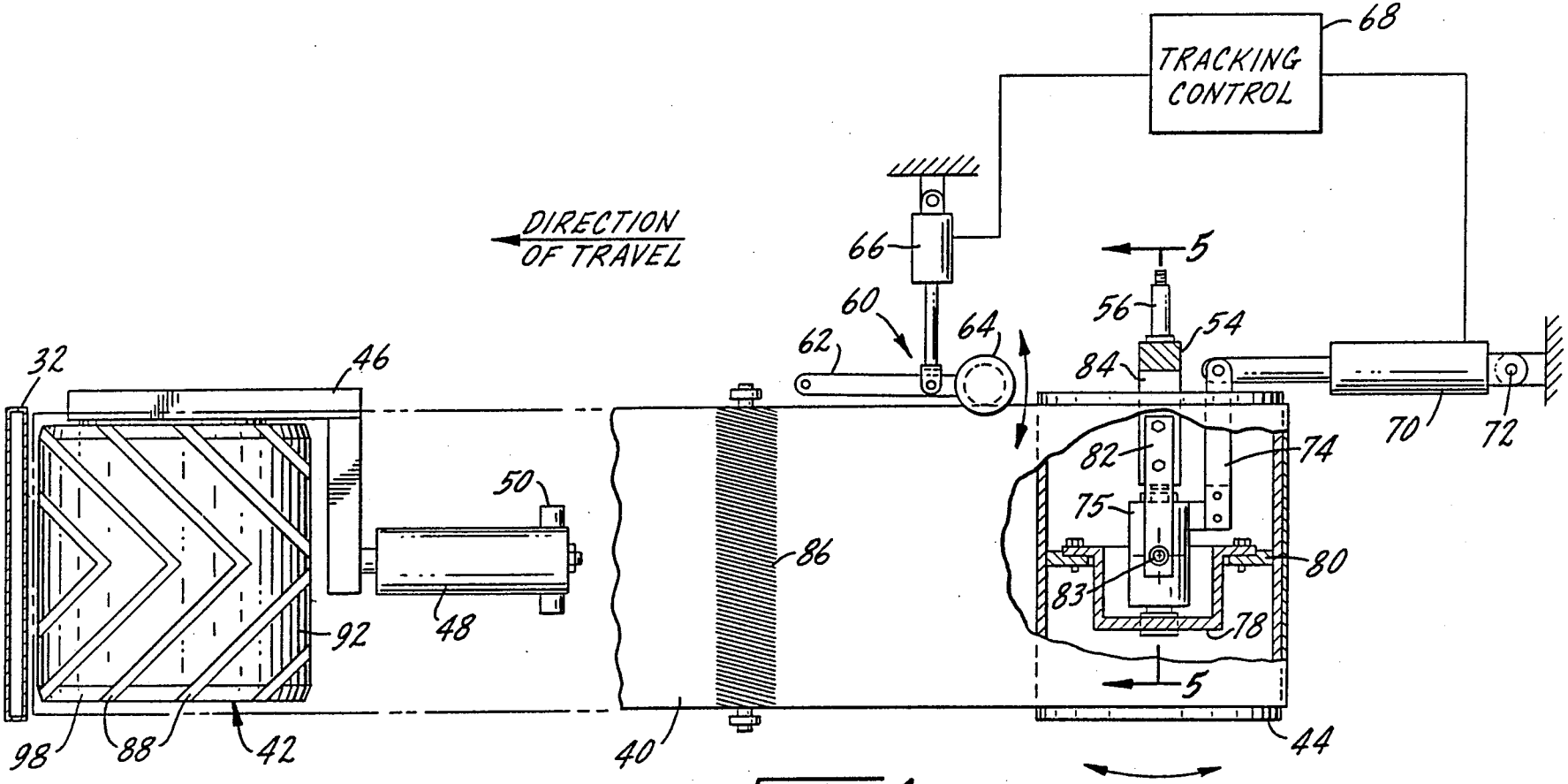
FIG. 4 is a top view of FIG. 2 as viewed along line 4—4 with parts removed and broken away for clarity.

A suitable belt edge sensing arrangement 60 in FIG. 4 may be used which may include a pivoted arm 62 with a grooved roller 64 on the end thereof for sensing the edge of the belt which may be converted into an electric signal as at 66 with a suitable tracking control 68 which operates an actuator 70 pivoted on the frame of the machine as at 72 and with its rod connected to a belt tracking pivot arm 74. The pivot arm 74 may be connected by a suitable bracket or the like to an idler drum pivot 75, shown in cross section in FIG. 5, which has a suitable shaft 76 projecting from one end thereof on which is mounted an idler drum hub 78. The hub 78 is offset, as shown in FIG. 4 and connected to the inside of the idler drum, as at 80. A yoke 82 is pivoted on each side of the idler drum pivot on a generally vertical axis 83, as shown in FIG. 5. The yoke is connected to an idler drum support arm 84 which is connected by welding or otherwise to the drum support arm 54. It will be noted in FIG. 4 that the attachment 80 of the idler drum hub to the idler drum is aligned more or less with the vertical axis 83 of the idler drum pivot.

A suitable cleaning tool 86 shown here in the form of a rotary wire brush may be positioned, for example, above the top throw of the belt and in contact therewith to remove free abrasive and surface coating residue which may tend to adhere to the surface of the belt.

The work wheel 42 is shown as having a relieved surface in the form of a plurality of generally equally spaced grooves 88, shown in this case as herringbone, which allow deflection and compression of the work surface thereof when it is pressed against the floor or surface being worked upon. While the groove pattern has been shown as a herringbone, it could be otherwise, for example a waffle, honeycomb, spaced pockets, grooves in a suitable pattern, a tread, etc. A soft work wheel is desirable to give adequate floor conformance. Relieving the surface of the work wheel gives it greater effective softness. The work wheel has a structural core or sleeve 90 in FIG. 6 which is surrounded by a soft elastomer 92 in which the grooves or relieving 88 are formed. The elastomer may be bonded or otherwise suitably attached to the core 90 which is in turn connected to a speed reduction transmission 94 which is driven by a suitable motor 96 or the like which in turn is mounted on and supported by the support arm 46.

The elastomer 92 has its edges chamfered as at 98 and the belt 40 is a little wider than the elastomer so that it overhangs or extends beyond the edges of the elastomer on each side, as at 100 in FIG. 6 for reasons explained later.

As shown in FIGS. 2 and 3, the free abrasive particles are fed from the abrasive slinger 34 in front of the work wheel, as at 102. The surface being worked upon has a coating or membrane which is indicated generally at 104 in FIG. 3. The abrasive belt 40 may be a commercially available abrasive belt, with abrasive particles permanently bonded to its outer surface. In FIG. 3, it is moving from left to right. The outer surface of the belt thus presents a series of pockets into which the free abrasive 102 moves or flows and is trapped therein and carried along by the belt and pressed against the surface or coating 104 as the abrasive belt moves rearwardly. The down pressure on the work wheel 42 should be such that the elastomer 92 will be compressed against the belt and surface for a certain distance in what may be considered a deflection zone as indicated at 106 in FIG. 3 thus applying a certain down force on the free abrasive particles or medium as it abrades or cuts the coating. After the so-called deflection zone 106 the abrasive belt moves away from the surface and the particles of free abrasive along with the cut material are nearly all left lying loose on the surface, as indicated at 108, to be picked up subsequently by a sweeper or other suitable means. Those that stick to the belt are removed by the belt cleaner 86.

The use, operation and function of the invention are as follows:

The invention is concerned with a machine and method for removing coatings and/or membrane from a floor or surface, although it may also be used to work a bare or soiled surface. The floor or surface may be uneven or wavy. In all cases the machine and method will leave the floor with a degree of surface texture that is suitable for accepting new coatings. The system uses an abrasive belt which functions as a driver element or member that receives free abrasive and works it against a surface, with pressure against the surface being applied by a work wheel which has a soft elastomeric exterior. A free abrasive is thus applied under a deformable load so that differential deflection is allowed across the width of a working zone. The system or method uniquely accommodates uneven surfaces, which are quite frequently encountered.

The belt type abrasive driver, which may have abrasive particles bonded to its exterior, does very little, if any, work in removing the coating from the floor.

Rather, the belt serves as a driver and provides a series of pockets which accept the free abrasive and work it across the surface under yieldable or deflectable pressure. A commercially available abrasive belt works well. It will have a relatively hard surface and will not be rapidly worn by the free abrasive particles. While a belt has been referred to and disclosed, it should be understood that in certain applications the work wheel could be surrounded by an abrasive sleeve which might require a cooling arrangement of some kind.

For example, in FIG. 1A a variant form has been shown in which an abrasive chute 32A has a rotary slinger 34A at its lower end which feeds or propels abrasive, like the arrangement shown in FIG. 1. A work wheel 42A has an abrasive sleeve 43 around its exterior. There are applications where, for cost reasons or for ease of ganging several units, an abrasive sleeve will be preferable to a belt. But a belt is considered better because it tends to be self-cooling.

Whereas the flexible driver which has been shown and described both as a belt and as a sleeve includes a backing or belt with abrasive particles bonded to it, it should be understood that in certain situations a flexible abrasive driver may not be needed, and a work wheel with a compressible exterior, supplied with the free abrasive, would be quite effective. And, FIG. 1A may be considered to represent such an arrangement. Or a driver may be used around the work wheel in the form of a non-abrasive belt or sleeve which could still grip free abrasive particles and pull them into the work zone. It could be changed from time to time when excessively worn.

When a belt is being used, it is desirable that the second wheel be relatively close to the surface being worked upon but above it somewhat. This has the advantage that variations and inclinations of the work wheel caused by the surface will cause a minimum misalignment of a low angle belt as compared to a belt that is, say, at a higher angle of inclination, for example 45°. The larger the angle of inclination, the more difficult tracking becomes.

The configuration of the work wheel is important. Its outer layer is a soft elastomer, made effectively still softer by a relieved surface, shown as a pattern of herringbone grooves. This construction allows the work wheel to compress when biased downwardly against the surface being worked upon, and thus it will conform to irregularities in the surface. At the same time the abrasive belt, being flexible, can deflect and will also conform to an uneven surface. Since concrete floors or surfaces are frequently uneven, it is desirable that the abrasive belt and work wheel be flexible and/or deflectable to conform to the surface. Also, the side edges of the work wheel are chamfered so that the edge of a cut will be feathered or beveled, which insures that the edges of adjacent cuts will smoothly feather into each other or blend together.

It will be noted that the abrasive belt is wide enough so that it extends beyond the ends of the work wheel. This is done so that there will always be belt under the outer ends of the work wheel, even when the belt shifts somewhat, which may be caused by the work wheel tilting, with corrections being applied by the tracking mechanism. Thus a straight edged cut is assured, even though the belt may be drifting back and forth laterally to some degree. This will also be of advantage when manufacturing tolerances cause the belt or work wheel to vary slightly in width.

The free abrasive feeding mechanism and the impeller at the bottom of the chute are important in that they control the feed rate of free abrasive to the work wheel and cause it to be thrown into the cutting zone. The feeding rate is controlled by the vibrator 30 which may be adjustable to set the rate of material supplied to the chute 32. Thus, overfeeding or underfeeding can be avoided, either of which will reduce the efficiency of the coating removal process. By the mechanism shown a controlled rate of free abrasive particles is provided to exactly effect the desired action.

The work wheel is movable and moves in two directions. First, it is pressed down against the surface being worked upon, and, second, it may swivel about the roll pivot 48 so that the work wheel and belt automatically conform to or match any inclines or slants in the floor or surface.

The belt tracking mechanism indicated at 60 has only been disclosed generally, but it should be understood that the tracking mechanism is important because the pivoting action of the work wheel about the roll pivot 48 will cause the belt to tend to move laterally off the work wheel. So, a sensing mechanism with a feedback to correspondingly adjust the alignment of the idler or follower roller to maintain proper belt tracking is important.

Cut material and free abrasive particles tend to cling to the belt to some extent, so a cleaning tool such as indicated at 86, which may be a rotary mounted wire brush or cleaning tool, is also considered important.

The surface speed of the belt and the down load or pressure on the work wheel in relation to the travel speed of the machine are important in effectively and efficiently removing a coating without melting or softening it, extending the life of the belt and avoiding the creation of excessive dust as well as acquiring the surface finish desired both as to appearance and coating adhesion. A belt speed in the neighborhood of 1500–2000 feet per minute relative to the floor or surface has been found to be suitable. One of the advantages of the present system is that high speed of the abrasive is not necessary which, if employed, will create enough heat to melt the surface coating. A melted coating becomes gummy and does not cut cleanly off the floor. Also, it adheres to the abrasive belt and quickly clogs it. A slower belt speed, which does not heat the floor very much, avoids these problems and uses less power.

Another advantage of the present system is that because the removal of the coating is quite even the resultant surface is quite uniform whether the old surface was uniformly coated or had patches of old coating and bare areas.

Yet another advantage of the present arrangement is that it removes all of the coating in one pass. The machine does not have to go over the surface several times. Thus it is economical to operate.

While one belt has been shown, it should be understood that if a greater width of removal is desired, a plurality of belts could be used in gangs with separate work wheels, abrasive hoppers, etc.

Whether the machine is used to remove a coating or a film or to prepare bare concrete for coating, it has the advantage that the degree of grind can be closely controlled. The desired result is to have the concrete a little open, which is to say, a little rough. You do not want to either over grind or under grind. You want the concrete open so that it will accept the next coating and bond it securely without absorbing excessive amounts of the coating material. The present machine and method can be closely controlled so the exact degree of openness desired in the resulting concrete is obtained.

This system for removing floor coatings is completely mechanical, and consequently has a major advantage over chemical systems which use solvents in that it does not release any toxic materials into the atmosphere during operation and does not generate any hazardous waste materials as a by-product.

While it has not been shown, it will be understood that there may be some dust created by the unit, so conventional shrouding and possibly a vacuum system and filter might be needed on the unit for dust control. If so, they can be readily installed using well-known techniques.

The use of an abrasive belt, sleeve or disk alone, without free abrasive, to grind off the surface has the disadvantage that whatever is used will dull and stop cutting very quickly due to contact with the concrete surface. Any one of these also will tend to clog very quickly with the material being removed, which reduces or eliminates the cutting action. Introducing free abrasive under the work wheel provides a continuous supply of new, sharp abrasive particles so an effective cutting action is maintained indefinitely. The spent abrasive particles carry away most of the material removed from the floor, so clogging of the belt is largely eliminated. The free abrasive can be a material which is low enough in cost that it is economically feasible to use it once and discard it along with the cut material that is removed from the floor or surface.

Using a cylindrical work wheel has the advantage as compared to a disc grinder in that it does not tend to overgrind on the periphery and undergrind in the center as a disc grinder does, but grinds uniformly across its width.

The tension required in the belt is related to the torque delivered to the work wheel. This in turn is related to the down pressure on the work wheel and its resulting deflection, the thickness and toughness of the coating being removed, and the smoothness of the concrete substrate. It is necessary to keep enough tension in the belt to prevent it from slipping on the work wheel, and this tension can be set by adjusting tensioning spring 58. The belt must have enough strength to withstand this tension. It has been found that commercially available abrasive belts with fabric backing have adequate strength.

While removing worn coatings from surfaces such as concrete floors has been mentioned, it should be understood that soilage and deposits may also be removed, for example accumulated rubber on airport runways and landing strips. As well, the machine and method may be used on various types of surfaces, for example, vinyl tile, wood, etc. Also, the device could be used on highways, steel floors, ship decks, etc.

When grinding a relatively soft surface, such as vinyl tile or wood, it may be possible to use the abrasive belt as the primary grinding medium without using any free abrasive and still achieve an acceptable life on the abrasive belt. When grinding a concrete surface it is desirable to use free abrasive because the abrasive belt, if used alone, quickly becomes dull and loses its cutting ability.

It might be desirable, in certain applications, to use a driver belt which is not coated with abrasive, but rather has a smooth or textile-like surface which would engage the free abrasive particles and drag them under the work wheel. However, the driver belt needs a hard surface to resist abrasion from the loose abrasive particles, and a coated abrasive belt possesses that hardness as well as having the other characteristics needed by this belt, namely a rough surface, flexibility, adequate tensile strength, and a relatively low coefficient of friction against some types of work surfaces, such as concrete.

Under certain circumstances, instead of the work wheel being driven, the second or idler roller might be driven, but it is preferred that the work wheel be the driven element.

While the preferred form and several variations of the invention have been shown, described and suggested it should be understood that suitable additional changes, variations, modifications and additions may be made without departing from the invention's fundamental theme.

The embodiments of the invention in which an exclusive property or privilege is claimed are defined as follows:

1. A method of removing unwanted material, such as a coating, membrane, soilage or the like, from a surface, including the steps of moving a flexible driver through a predetermined path under down force against the surface being worked upon thereby creating a working zone, supplying free abrasive particles to the working zone between the driver and the surface and in a direction so that the particles will tend to be moved by the driver through the working zone, allowing the particles to be moved by the driver through the working zone in contact with the surface, continuing the down force on the driver and abrasive particles while they are in the working zone to cause them to remove unwanted material from the surface, and moving the driver over the surface at a rate of travel less than the relative motion between the exterior of the driver and a point on the surface being worked upon while continuing the supply of free abrasive particles between the driver and the working zone.

2. The method of claim 1 further including the step of causing the driver to flexibly conform itself to irregularities in the surface.

3. The method of claim 1 further characterized by and including the step of allowing the driver to tilt about an axis generally parallel to its direction of movement in the working zone to enable it to conform to irregularities in the surface.

4. The method of claim 1 further characterized by and including the step of providing a plurality of preformed exposed pockets on the exterior of the flexible driver to be moved through the working zone with the driver, and allowing the free abrasive particles to be received in and moved by the pockets through the working zone.

5. A method of removing unwanted material, such as a coating, membrane, soilage or the like, from an irregular surface, including the steps of moving a flexible driver through a predetermined path against the surface being worked upon thereby creating a working zone, applying a predetermined down force against the driver as it moves through the working zone, creating an abrasive medium in the working zone between the driver and the surface, continuing the predetermined down force on the driver and abrasive medium in the working zone to cause them to remove unwanted material from the surface, maintaining the down force on the driver against the surface approximately constant as the driver encounters irregularities in the surface, providing a free abrasive medium, and moving the free abrasive medium between the driver and the surface.

6. The method of claim 5 further including the step of causing the driver to flexibly conform itself to irregularities in the surface.

7. The method of claim 5 further characterized by and including the step of allowing the driver to tilt about an axis generally parallel to its direction of movement in the working zone to enable it to conform to irregularities in the surface.

8. The method of claim 5 further characterized and including the step of providing a plurality of exposed pockets on the exterior of the flexible driver to be moved through the working zone with the driver, and allowing the free abrasive particles to be received in and moved by the pockets through the working zone.

9. The method of claim 8 further including the step of moving the driver over the surface at a rate of travel less than the relative motion between the exterior of the driver and a point on the surface being worked upon while continuing the supply of free abrasive particles between the driver and the working zone.

10. In a machine for removing unwanted material, such as a coating from a surface, a mobile frame, a generally cylindrical work wheel on the frame disposed for rotation about a generally horizontal axis, a second wheel on the frame in spaced relation to the work wheel and above the surface being worked upon, a flexible belt around the work wheel and second wheel and means for tensioning the belt, means for biasing the work wheel and the portion of the belt under it against the surface being worked upon, means allowing the work wheel to tilt about an axis generally parallel to the direction of movement of the machine so that the work wheel and the belt under it will automatically conform to irregularities in the surface being worked upon, and a tracking mechanism on the frame for detecting lateral movement of the belt and for automatically centering the belt on the work wheel.

11. The structure of claim 10 further characterized in that the tracking mechanism includes a belt edge sensing device.

12. The structure of claim 10 further characterized in that the tracking mechanism includes means for adjusting the second wheel about a generally vertical axis to compensate for lateral movement of the belt on the work wheel.

13. The structure of claim 10 further characterized in that the second wheel is closely adjacent but out of contact with the surface being worked upon.

14. The structure of claim 10 further characterized in that the means for tensioning the belt is constructed and arranged to separate the wheels.

15. The structure of claim 10 further characterized by and including a source of free abrasive particles on the frame, and means for propelling the free abrasive particles onto the surface under the work wheel and belt.

16. The structure of claim 10 further characterized in that the work wheel has a compressible exterior with the general characteristics of rubber as to flexibility and distortability so as to provide compressibility to the exterior of the work wheel as it and the belt are biased against the surface.

17. The structure of claim 10 further characterized by and including means allowing the work wheel to tilt so that it automatically conforms to irregularities in the surface being worked upon.

18. The structure of claim 10 further characterized in that the outer surface of the belt is coated with abrasive particles.

19. In a machine for removing unwanted material, such as a coating from a surface, a mobile frame and means for propelling it, a generally cylindrical work wheel on the frame disposed for rotation about a generally horizontal axis, power means for rotating the work wheel, means for biasing the work wheel toward the surface, a source of free abrasive on the frame, and means for supplying free abrasive between the work wheel and the surface being worked upon to remove a coating from the surface.

20. The structure of claim 19 further characterized by and including a flexible belt disposed about the work wheel and a roller which is in spaced relationship to the work wheel to maintain the belt in tension, the abrasive supplying means being disposed to supply free abrasive between the exterior of the belt and the surface being worked upon in a direction so that the free abrasive will be drawn between the flexible belt and the surface being worked upon.

21. The structure of claim 19 further characterized in that the means for supplying free abrasive includes power means for propelling the free abrasive between the bottom of the work wheel and the surface being worked upon.

22. The structure of claim 19 further characterized by and including a compressible exterior on the work wheel having the general characteristics of rubber as to flexibility and distortability to provide compressibility to the exterior of the work wheel so that it will conform to irregularities in the surface, and a pattern of herringbone shaped relief areas in the compressible exterior.

23. The structure of claim 19 further characterized by and including means for rotating the work wheel in a direction bottom side to the rear relative to the direction of travel of the machine and at a peripheral rate of travel greater than the speed of travel of the machine.

24. The structure of claim 19 further characterized by and including a flexible abrasive belt around the work wheel and between it and the surface being worked upon, and means on the frame for tensioning the belt.

25. The structure of claim 19 further characterized in that the work wheel is surrounded by an abrasive sleeve.

26. The structure of claim 19 further characterized by a compressible exterior on the work wheel having the general characteristics of rubber as to flexibility and distortability to provide compressibility to the exterior of the work wheel so that it will conform to irregularities in the surface.

27. The structure of claim 26 further characterized by and including a pattern of relief areas on the exterior of the work wheel to provide increased distortability.

28. The structure of claim 26 further characterized in that the compressible exterior is in the form of a rubber-like sleeve mounted on a structural core.

29. In a machine for removing unwanted material, such as a coating from a surface, a mobile frame and means for propelling it, a generally cylindrical work wheel on the frame disposed for rotation about a generally horizontal axis with its periphery adjacent the surface, power means for rotating the wheel, a flexible exterior on the work wheel having the general characteristics of rubber as to flexibility and distortability, a pattern of relief areas for the compressible exterior to provide increased distortability where the work wheel is in contact with the surface, and an abrasive medium between the work wheel and the surface being worked upon.

30. The structure of claim 29 further characterized in that the pattern of relief areas includes a plurality of grooves.

31. The structure of claim 30 further characterized in that the grooves are in the form of a herringbone.

32. The structure of claim 29 further characterized in that the compressible exterior on the work wheel is in the form of a rubberlike sleeve mounted on a structural core.

33. The structure of claim 29 further characterized in that the abrasive medium includes a flexible abrasive exterior around at least a part of the work wheel.

34. The structure of claim 29 further characterized in that the abrasive medium includes a flexible abrasive belt.

35. The structure of claim 29 further characterized in that the abrasive medium includes a flexible abrasive sleeve around the work wheel.

36. In a device for removing unwanted material, such as a coating from a surface, a mobile frame and power means for propelling it, a generally cylindrical work wheel on the frame disposed for rotation about a generally horizontal axis with its periphery adjacent the surface, a second wheel on the frame in spaced relation to the work wheel, a flexible belt around the work wheel and second wheel and means for tensioning the belt between them, means for biasing the work wheel and belt against the surface being worked upon, the belt being somewhat wider than the work wheel so that a straight cut will be taken on the surface even if the belt moves somewhat laterally on the work wheel, power means for driving at least one of the wheels, a trackig mechanism for sensing lateral movement of the belt, and means responsive to the tracking mechanism for adjusting the second wheel so that the belt will be maintained generally centered on the work wheel.

37. The structure of claim 36 further characterized in that the power means drives the work wheel.

38. The structure of claim 36 further characterized in that the belt is a flexible abrasive belt.

39. The structure of claim 36 further characterized in that the work wheel has a compressible exterior having the general characteristics of rubber as to flexibility and distortability, and a pattern of relief areas in the compressible exterior to provide for increased distortability.

40. In a machine for removing unwanted material, such as a coating from a surface, a mobile frame and means for propelling it, a generally cylindrical work wheel on the frame disposed for rotation about a generally horizontal axis with its periphery adjacent to the work surface, power means for rotating the work wheel, an abrasive medium between the bottom of the work wheel and the surface being worked upon, and means for applying and maintaining a generally constant down force by the work wheel and abrasive medium on the surface being worked upon as the work wheel follows changes in the contours of the surface, the abrasive medium including a free abrasive supplied between the work wheel and the surface being worked upon.

41. The structure of claim 40 further characterized in that the abrasive medium includes a flexible abrasive belt.

42. The structure of claim 40 further characterized in that the abrasive medium includes an abrasive cylinder around the work wheel.

43. The structure of claim 40 further characterized by and including means for mounting the work wheel so that it may tilt relative to the frame about an axis generally parallel to its direction of movement in the working zone to enable it to conform to irregularities in the surface being worked upon.

44. The structure of claim 40 further characterized in that the means for applying and maintaining a generally constant down force is hydraulic.

45. The structure of claim 40 further characterized in that the means for applying and maintaining a generally constant down force is pneumatic.

46. The structure of claim 40 further characterized in that the means for applying and maintaining a generally constant down force is electrical.

47. In a machine for removing unwanted material, such as a coating, membrane, soilage or the like, from a surface, a generally cylindrical work wheel adapted to be disposed for rotation about a generally horizontal axis with its periphery adjacent the surface, a compressible exterior on the work wheel having the general characteristics of rubber as to flexibility and distortability, and an abrasive medium between the work wheel and the surface being worked upon, each end of the compressible exterior being slightly chamfered so that adjacent cuts on the surface being worked upon will be feathered together and will blend.

48. The structure of claim 47 further characterized by and including a pattern of relief areas for the exterior of the work wheel to provide for increased distortability.

49. The structure of claim 47 further characterized in that the abrasive medium is at least in part a belt that is disposed about the work wheel and around a second wheel in spaced relation to the work wheel.

50. The structure of claim 47 further characterized in that the compressible exterior on the work wheel is in the form of a rubberlike sleeve mounted on a structural core.

51. The structure of claim 50 further characterized by and including a series of grooves in the rubberlike sleeve of the work wheel in a herringbone pattern.

52. The structure of claim 47 further characterized by and including a second wheel in spaced relation to the work wheel, a flexible belt around both wheels, and power means for driving the work wheel.

53. The structure of claim 47 further characterized by and including a second wheel in spaced relation to the work wheel, a flexible belt around both wheels, and power means for driving the second wheel so that the work wheel will be driven by the belt.

54. In a machine for removing unwanted material, such as a coating from a surface, a mobile frame with a defined direction of travel, a generally cylindrical work wheel on the frame disposed for rotation about a generally horizontal axis transverse to the direction of travel with the periphery of the wheel adjacent to the surface, power means for propelling the machine and rotating the work wheel, an abrasive medium between the periphery of the wheel and the surface for removing a coating therefrom, and a pivotal mounting so that the wheel may pivot about an axis generally parallel to the direction of travel to permit the periphery of the wheel to conform to irregularities in the surface.

55. The structure of claim 54 further characterized in that the abrasive medium includes an endless flat belt having its outer surface coated with abrasive particles.

56. The structure of claim 54 further characterized in that the abrasive medium includes a source of free abrasive particles on the frame, and means for propelling the free abrasive particles under and in front of the work wheel.

57. The structure of claim 54 further characterized in that the abrasive medium includes an abrasive sleeve mounted on the work wheel.

58. The structure of claim 54 further characterized in that the work wheel has a compressible exterior.

* * * * *